US009987549B2

(12) United States Patent
Vandoren

(10) Patent No.: US 9,987,549 B2
(45) Date of Patent: Jun. 5, 2018

(54) GAME PIECES AND A SET OF SUCH GAME PIECES

(75) Inventor: Rolf Vandoren, Kontich (DE)

(73) Assignee: SMART, NAAMLOZE VENNOOTSCHAP, Kontich (BE)

( * ) Notice: Subject to any disclaimer, the term of this patent is extended or adjusted under 35 U.S.C. 154(b) by 536 days.

(21) Appl. No.: 14/003,123

(22) PCT Filed: Mar. 1, 2012

(86) PCT No.: PCT/BE2012/000010

§ 371 (c)(1),
(2), (4) Date: Sep. 4, 2013

(87) PCT Pub. No.: WO2012/119208

PCT Pub. Date: Sep. 13, 2012

(65) Prior Publication Data

US 2013/0341868 A1 Dec. 26, 2013

(30) Foreign Application Priority Data

Mar. 4, 2011 (BE) ..... 2011/0150

(51) Int. Cl.
*A63F 3/00* (2006.01)

(52) U.S. Cl.
CPC ..... *A63F 3/00697* (2013.01)

(58) Field of Classification Search
CPC .. A63F 3/00697; A63F 9/0669; A63F 9/1288; A63H 33/042; A63H 33/062
USPC ..... 273/157 R, 160, 153 P, 153 S, 288, 289, 273/290
See application file for complete search history.

(56) References Cited

U.S. PATENT DOCUMENTS

| | | | | |
|---|---|---|---|---|
| 3,374,917 | A * | 3/1968 | Troy | 220/23.4 |
| 3,596,396 | A * | 8/1971 | Thomson | 446/487 |
| 4,378,116 | A * | 3/1983 | Rubik | 273/153 S |
| 4,392,323 | A | 7/1983 | Rubik | |
| 4,437,667 | A * | 3/1984 | Miller | 273/153 S |
| 4,461,480 | A * | 7/1984 | Mitchell | 273/153 S |
| 4,470,601 | A * | 9/1984 | Finn | 273/153 S |
| 4,593,907 | A * | 6/1986 | Abu-Shumays et al. | 273/153 S |
| 4,676,762 | A * | 6/1987 | Ballard | 446/104 |
| 5,310,183 | A * | 5/1994 | Glikmann | 273/153 S |
| 5,525,089 | A * | 6/1996 | Heinz | 446/119 |
| 5,529,301 | A * | 6/1996 | Feller | 273/153 S |
| 5,868,388 | A * | 2/1999 | Wood et al. | 273/157 R |
| 6,129,356 | A * | 10/2000 | Li | 273/153 S |
| 6,241,248 | B1 * | 6/2001 | Winter | 273/153 S |
| 6,382,625 | B1 * | 5/2002 | Chang | 273/160 |
| 6,482,063 | B1 * | 11/2002 | Frigard | 446/119 |
| 6,893,020 | B1 * | 5/2005 | Snyder | 273/290 |
| 7,255,345 | B2 * | 8/2007 | Wood et al. | 273/157 R |
| 7,980,560 | B2 * | 7/2011 | Belykh | 273/153 S |
| 2012/0274023 | A1 * | 11/2012 | Carpenter | 273/276 |

* cited by examiner

*Primary Examiner* — Vishu Mendiratta

(57) ABSTRACT

Game piece in the form of a polyomino or polycube or similar, consisting of a number of blocks (5) that are put together in an orthogonal pattern, characterized in that the game piece (4) comprises at least two parts (6) that are each formed by a number of aforementioned blocks (5) connected together in a fixed way, whereby these parts (6) are slidably coupled with respect to one another in such a way that they enable a number of forms of game pieces (4) to be formed with the game piece (4) concerned.

16 Claims, 13 Drawing Sheets

GAME PIECES AND A SET OF SUCH GAME PIECES

BACKGROUND OF THE INVENTION

FIELD OF THE INVENTION

The present invention relates to game pieces.

More specifically the invention relates to game pieces in the form of polyominoes or polycubes or related forms of game pieces.

Specifically, polyominoes are game pieces formed by a number of blocks in the form of squares placed in a plane in an orthogonal pattern, such that they form one fixed game piece and such that they touch each other on at least one side.

By connecting the blocks to one another in different ways, for a given number of blocks different polyomino figures can be obtained that can each form a game piece.

Such game pieces consisting of 4, 5 and 6 squares are designated respectively by the terms tetrominoes, pentominoes and hexominoes.

With pentominoes, for example, twelve different game pieces can be formed if the game pieces that are a mirror image of one another are only counted as one game piece. If game pieces with a mirror image are counted as separate game pieces, then eighteen different pentominoes can be formed.

The greater the number of blocks, the greater the number of polyominoes that can be formed with that number of blocks.

Polyominoes can be used in all kinds of games and puzzles.

It is known for example to completely fill, without gaps or overlaps, a rectangular game board with 6×10 square spaces with pentominoes whose blocks themselves have the same dimensions as the board spaces. Such a puzzle offers 2339 possible solutions to fill the game board with pentominoes.

By extension to three dimensions, it is also known to have polycubes consisting of a number of cubic blocks connected together in a fixed way, that are not only combined together in a plane in two directions, but also along a third direction perpendicular to this plane, whereby at least one side of each block touches one of the sides of the other blocks.

Such polycubes can for example be used as game pieces in a 3D puzzle, in which a 3D space of 2×5×6 cubic sections for example must be filled with polycubes without gaps or overlaps.

DESCRIPTION OF RELATED ART

Polycubes as building blocks for creating complexly shaped constructions, wherein said building blocks are changeable between one form and another form are known from EP 0.110.800.

Also playing elements or toys in the form of polycubes in which the shape of the playing elements may be changed by a rotational movement are known from eg GB 2.090.751 and WO 2005/002696

BRIEF SUMMARY OF THE INVENTION

The purpose of the present invention is to create game pieces which, compared to the known game pieces, provide extra possibilities for devising all kinds of games.

The kinds of games and the associated game pieces are intended for use in puzzle-type games in which a two dimensional field or a three dimensional volume is to be filled completely or to a certain degree by consecutively placing game pieces and/or in strategy-type games in which one of a set of predefined winning placements needs to be made in a multi-player game wherein the placement of a game piece by a certain player influences the remaining options for the other players.

To this end the invention concerns a game piece in the form of a polyomino or polycube or similar, consisting of a number of blocks that are put together in an orthogonal pattern, whereby the game piece comprises at least two parts that are each formed by a number of aforementioned blocks connected together in a fixed way, whereby these parts are slidably coupled with respect to one another in such a way that they enable a number of forms of game pieces to be formed with the game piece concerned.

Preferably the aforementioned parts are movable with respect one another in such a way that they enable different forms of polyominoes or polycubes or similar to be formed with the game piece concerned, and can thus be changed between a number of forms.

According to a preferred embodiment, the game piece consists of square or cubic blocks and the aforementioned parts can be slid on at least one side with respect to one another in a direction parallel to one of the sides of such a square or cubic block, more specifically in the direction of this side.

According to another preferred embodiment, the parts of the game piece that are movable with respect one another are affixed together by means of a hinge.

The invention also relates to a set of game pieces according to the invention, to a game that is provided with such game pieces and to the use of such a game piece in specific games.

With the intention of better showing the characteristics of the invention, a few preferred embodiments of game pieces according to the invention are described hereinafter by way of an example, without any limiting nature, with reference to the accompanying drawings, wherein:

BRIEF DESCRIPTION OF SEVERAL VIEW OF DRAWINGS

Figure 5:
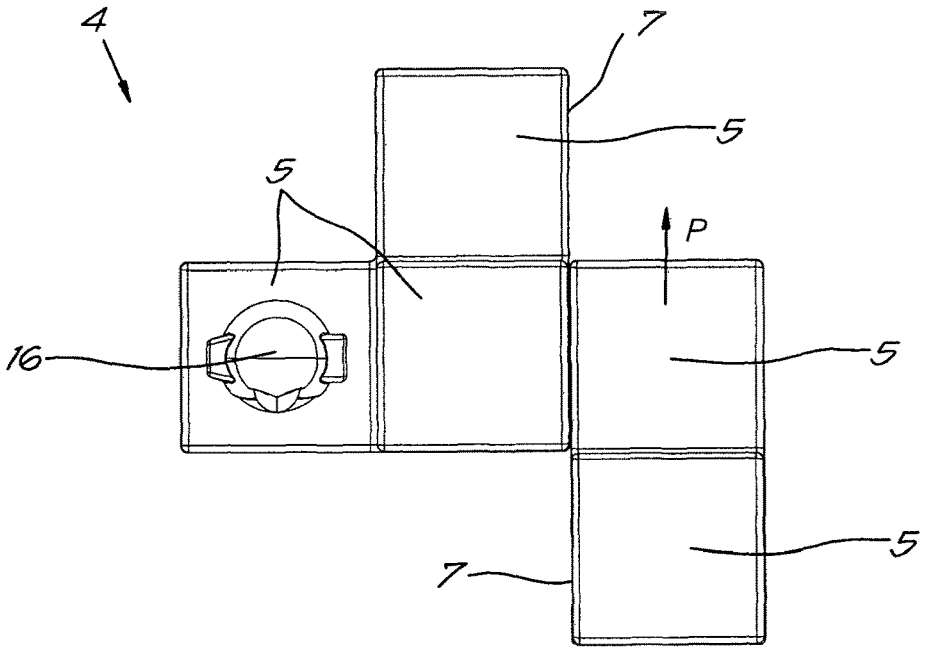
FIG. 5 shows a top view according to arrow F5 of FIG. 4.
Figure 6:
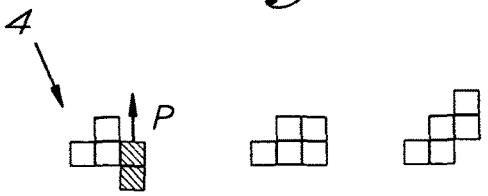

FIG. 6 schematically shows, on a smaller scale, the different possible forms that can be obtained with the game piece of FIG. 5;

FIGS. 7 to 46 each show, for a variant embodiment of a game piece according to the invention, the different possible forms that can be obtained for the game piece concerned.

DETAILED DESCRIPTION OF THE INVENTION

Figure 1:
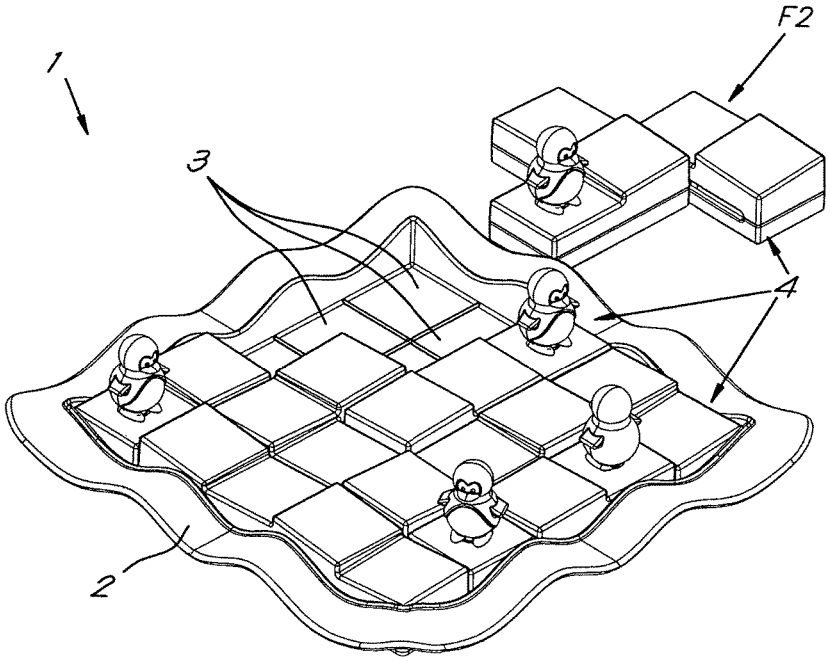
FIG. 1 shows a game in the form of a puzzle with game pieces according to the invention.
Figure 2:
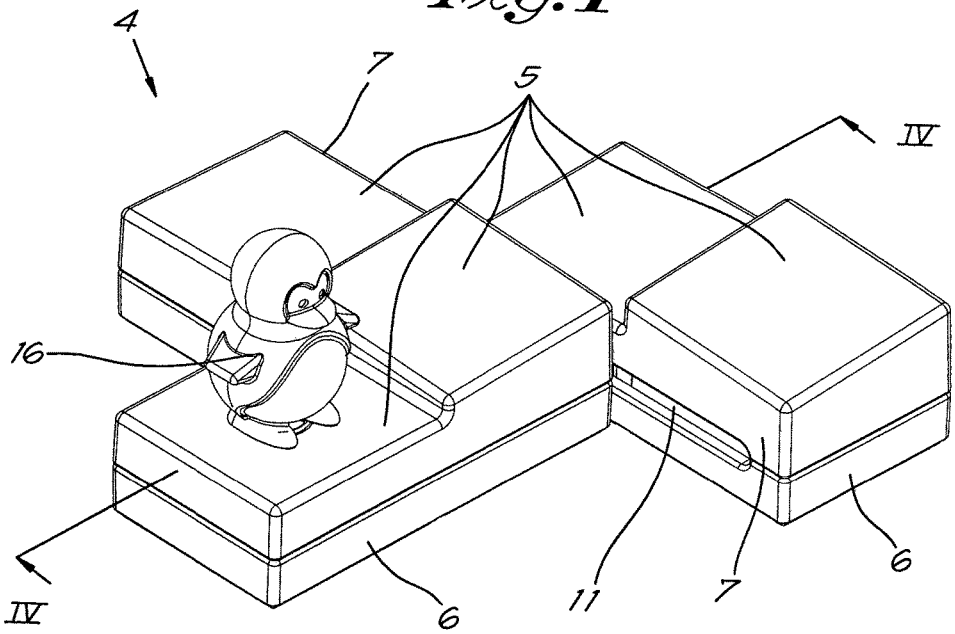
FIG. 2 shows the game piece, on a larger scale, designated by F2 in FIG. 1.

The game 1 shown in FIG. 1 is a puzzle with a game board 2 with 5×5 square spaces 3 and a set of game pieces 4 of a different form, of which only a limited number are shown in the drawing.

In this case the game pieces 4 are flat game pieces in the form of polyominoes each with five square blocks 5 that are put together in an orthogonal pattern, and which have the same dimensions as the spaces 3 of the game board 2.

Such polyominoes with five blocks 5 are known by the name of pentomino.

The aim of the puzzle 1 is to completely cover all the spaces 3 of the game board 2 with the available pentominoes without leaving gaps or overlaps.

The characteristic of the game pieces 4 according to the invention is that at least a number of the game pieces 4 consist of at least two parts 6 that are each formed by a number of aforementioned blocks 5 connected together in a fixed way, whereby these parts 6 are movably coupled to one another in such a way that they enable a number of forms of game pieces to be formed with the game piece 4 concerned.

In the example of FIGS. 2 to 5, the game piece 4 consists of two parts 6, respectively a part with three blocks 5 and a part with two blocks 5, in which the blocks 5 of each part are connected together in a fixed way along one side in an orthogonal pattern.

Both parts can be slid with respect to one another along a side 7, as schematically shown in FIG. 5 with an arrow P, which shows in which direction the part 6 with two blocks 5 can be slid with respect to the part 6 with three blocks 5.

This slideability enables a number of other forms of pentominoes to be formed with the pentomino of FIG. 5. All possibilities are shown in FIG. 6, which shows that in this case three possible forms of a pentomino can be formed.

Figure 3:
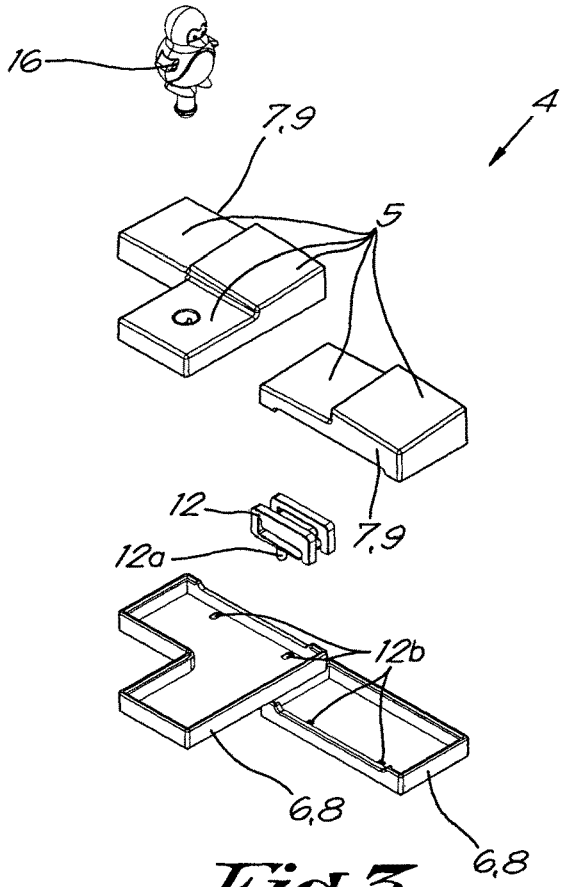
FIG. 3 shows an exploded view of the game piece of FIG. 2 on a smaller scale.
Figure 4:
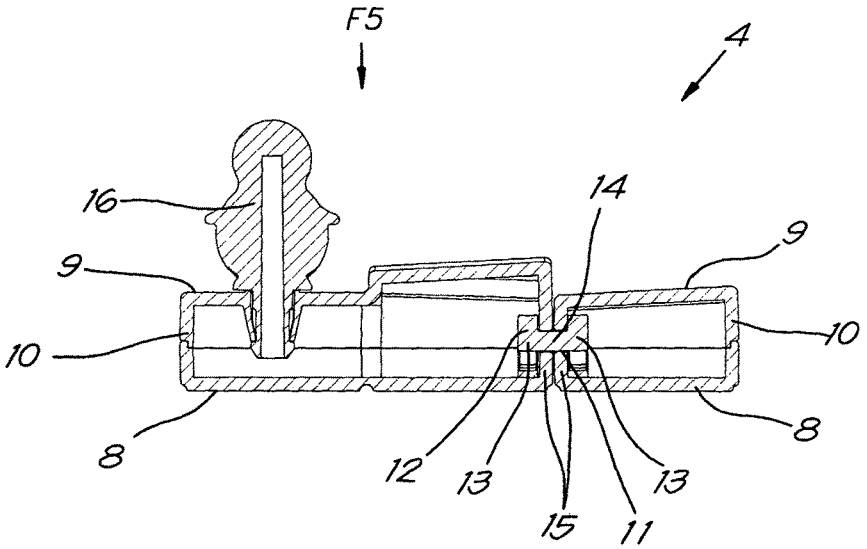
FIG. 4 shows a cross-section according to line IV-IV of FIG. 2.

In order to realise this mutual slideability, a simple embodiment of a mechanism that enables this movement is shown in FIGS. 3 and 4 by way of an example.

The aforementioned parts 6 are hollow with a base 8 and a cover 9 connected together along their periphery by edges 10, whereby a groove 11 is created in the edge 10 on the sides 7 along which the parts 6 of the game piece 4 can slide with respect one another, in which a sliding part 12 can be inserted in a slideable way, whereby the sliding part 12 ensures the slideable link between the two parts 6.

The groove 11 extends over a number of blocks 5.

In this case the sliding part 12 is constructed with an I-shaped profile with two parallel flanges 13 that are connected together by a central rib 14, whereby, as shown in FIG. 4, the edges 15 of the grooves 11 of the two parts 6 of the game piece are held between the aforementioned parallel flanges 13 of the sliding part 12.

Preferably the aforementioned edges 15 of the grooves 11 are suitably held between the flanges 13 of the sliding part 12 and the thickness of the central rib is approximately equal to the width of the aforementioned groove 11, all such that there is little play between the two parts 6.

The base 8 and the cover 9 are preferably each formed as a separate component, such that when assembling the base 8 and the cover 9 together, the sliding part 12 can be easily inserted in place between the base 8 and the cover 9.

The base 8 and the cover 9 are secured to each other by gluing, welding or other techniques.

The sliding part 12 is provided with projections 12*a*, and the base 8 is provided with matching recesses 12*b*. When sliding the parts 6, in certain positions the projections 12*a* fall into the recesses 12*b*. The user can feel, so is provided with sensible feedback, and possibly also hear, that the parts are positioned as intended, meaning in an orthogonal position forming a polyomino.

In the example of FIGS. 1 to 5, the game pieces 4 have a protruding part 16 on the top, here in the shape of a penguin figure, that prevents the game piece 4 from being used upside down on the game board 2. Other facilities to prevent this are not excluded.

Game pieces 4 without such a figure are obviously also possible. If the top surface of the covers 9 and the bottom surface of the bases 8 are then parallel, the game pieces 4 can be used as shown, as well as upside down.

Conversely it can also be chosen to leave out the protruding part 16 and to make the cover 9 flat in order to enable the game piece to be used on both sides, in other words on one side with the base 8 resting on the game board 2, but also inversely with the other side formed by the cover 9 resting on the game board 2.

Figure 7:
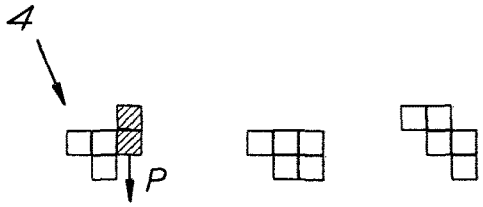
Figure 8:
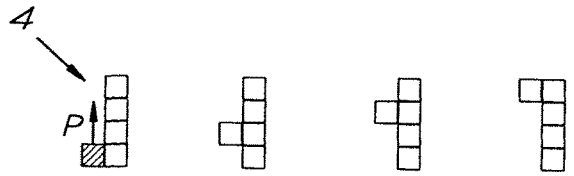
Figure 9:
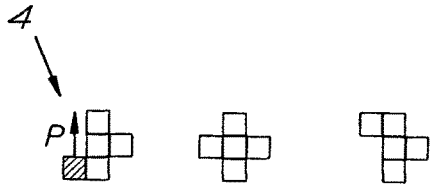
Figure 10:
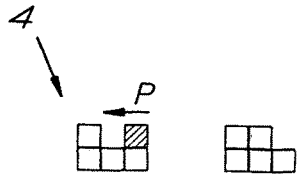
Figure 11:
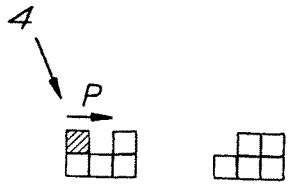
Figure 12:
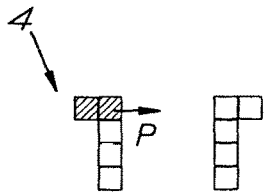
Figure 13:
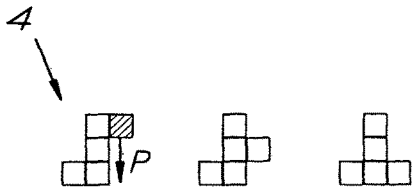
Figure 14:
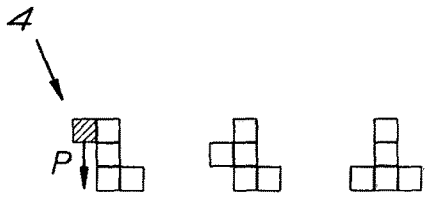
Figure 15:
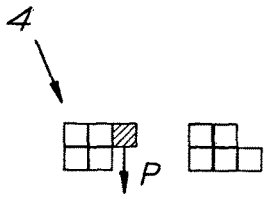
Figure 16:
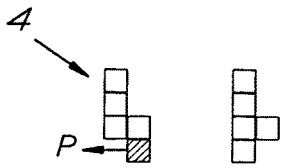
Figure 17:
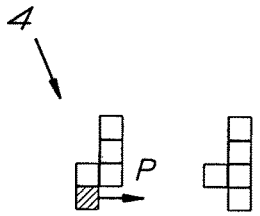
Figure 18:
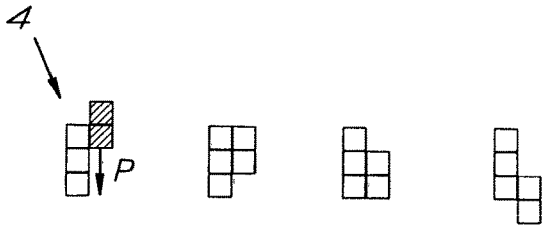
Figure 19:
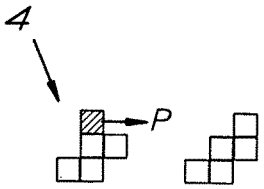
Figure 20:
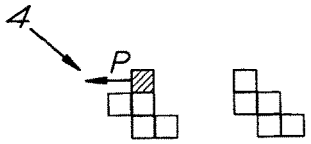
Figure 21:
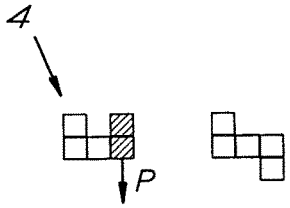
Figure 22:
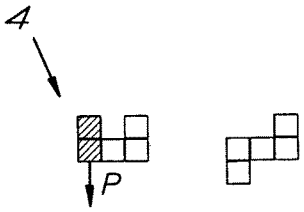
Figure 23:
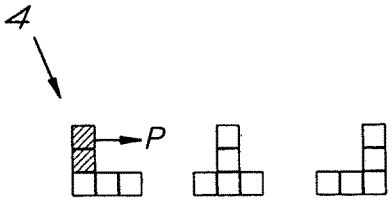
Figure 24:
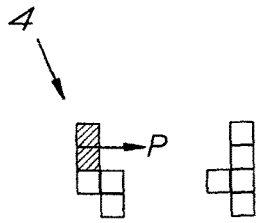
Figure 25:
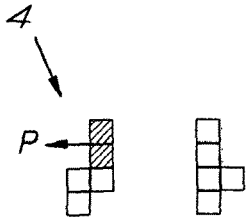
Figure 26:
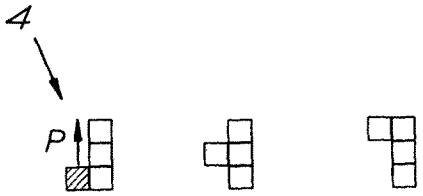
Figure 27:
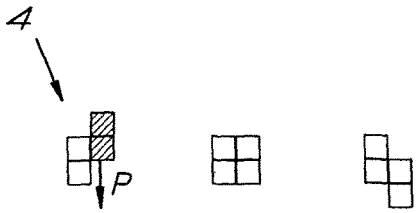
Figure 28:
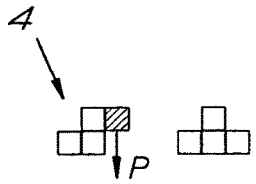
Figure 29:
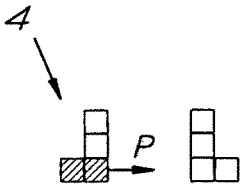
Figure 30:
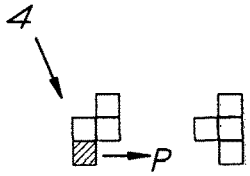

This enables extra forms of pentominoes to be obtained with the same game piece 4. The possible forms that can be obtained in this way are shown in FIG. 7, whereby it is notable that these forms are different to the forms shown in FIG. 6, although both figures relate to the same game piece 4, at least insofar the penguin FIG. 16 is left out to enable the game piece to be used on both sides.

FIGS. 8 to 25 show other possible variants of flat game pieces 4 according to the invention with five blocks 5 that are divided into two parts 6 that can be moved with respect one another, whereby each drawing shows the different possible pentominoes that can be formed for one possible variant.

The sliding mechanism with a sliding part 12 which is not fixed to either of the parts 6 that need to be slidable with respect to each other, but which is slidable in grooves which extends over several blocks 5, allows a large number of configurations, even allowing one part 6 to extend, in two opposite directions, beyond the other part 6. This is for instance clear from the first and last subfigure of FIG. 18.

It is clear that the invention is not limited to game pieces 4 with five blocks 5, but also smaller or larger number of blocks are among the possibilities, as illustrated in the drawings. For example, see FIGS. 8-11 and 13-17 which illustrate blocks 5 as one block.

FIGS. 26 to 30 show game pieces 4, for example, with four blocks 5 and two parts 6 that can be slid with respect to one another to form different forms of 'tetrominoes'.

Figure 31:
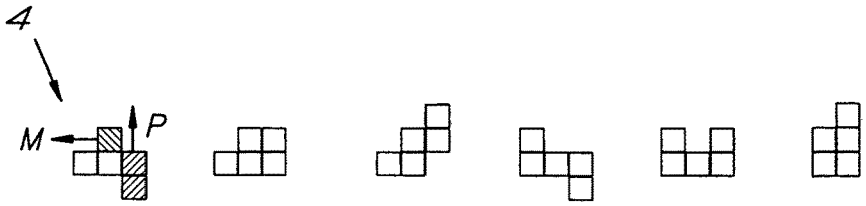
Figure 32:
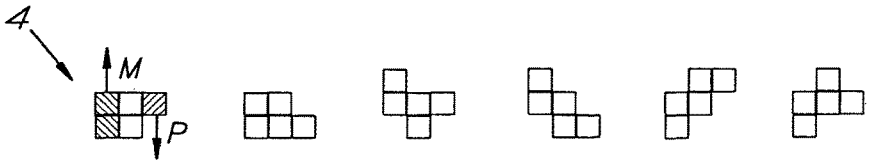
Figure 33:
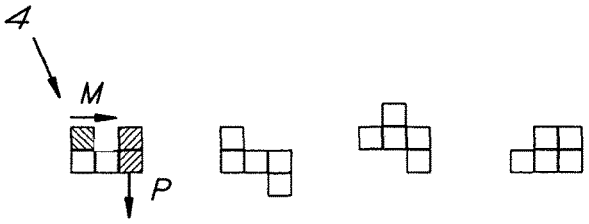
Figure 34:
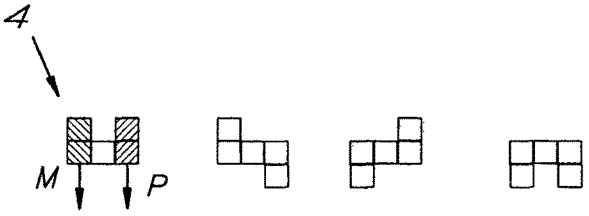
Figure 35:
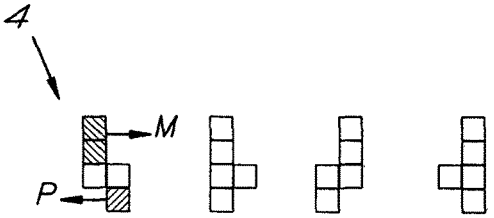
Figure 36:
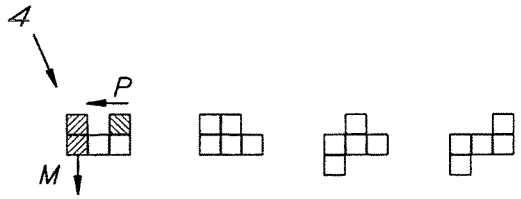
Figure 37:
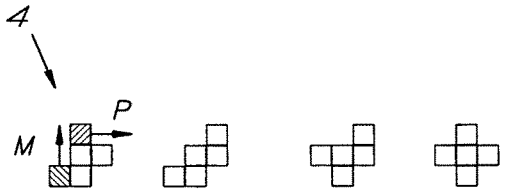
Figure 38:
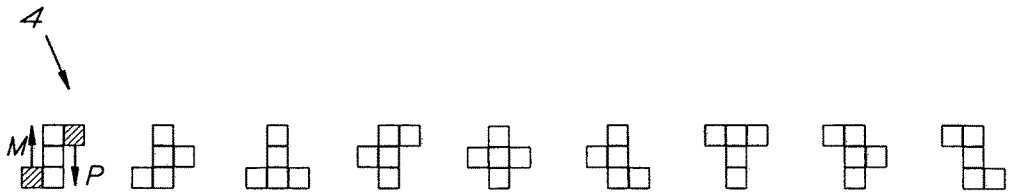

FIGS. 31 to 38 show other variants of game pieces 4 according to the invention, whereby in this variant the game pieces 4 have five blocks that are divided into three parts 6 that can be moved two by two with respect to each other, as shown by the two arrows P and M in FIG. 31.

Figure 39:
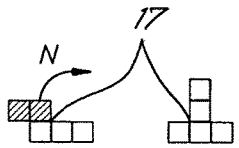

FIG. 39 shows a further variant of a game piece 4 according to the invention, whereby in this case the parts 6 of the game piece can be coupled to each other in a movable way by a hinge 17 that enables the parts 6 to turn with respect to one another, as shown by the arrow N.

In this case the hinge 17 is affixed at one of the corner points of the blocks 5, whereby two blocks 5 are connected together at a corner point, and it is perpendicular to the plane of the game piece.

As a result two different forms of a pentomino can be formed, as illustrated in FIG. 39.

Figure 40:
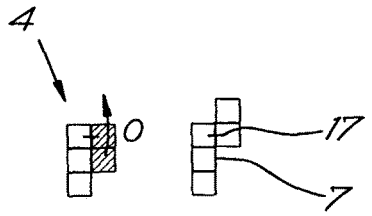

FIG. 40 shows another possible variant in which the hinge 17 is affixed perpendicularly to a side 7 of a block 5 and in the plane of the game piece 4, whereby a part 6 can be turned around with respect to the other part 6, as in FIG. 39 with arrow O.

Figure 41:
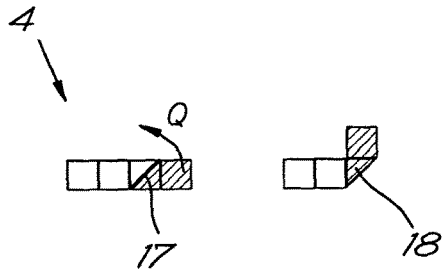

FIG. 41 shows a further variant where in this case the hinge 17 is affixed along a diagonal of a block 5 of the game piece 4, whereby one part 6 can be turned along this diagonal with respect to the other part 6, as shown with the arrow Q.

As a result, from the block 5 concerned with hinge 17 only a triangle 18 remains, which can cover a section of the game board together with a remaining triangle of another game piece.

Figure 42:
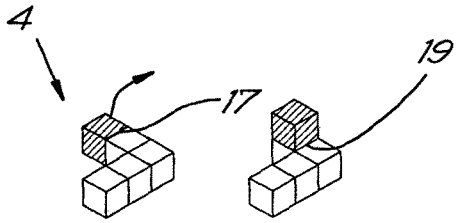

FIG. 42 shows another variant of a game piece 4 according to the invention in the form of a polycube consisting of two parts 6 consisting of cubic blocks 5, whereby in this case three-dimensional figures can be obtained, for example by one part 6 being turnable with respect to another part 6 around a hinge 17 that extends along the two ribs 19 of two adjacent cubic blocks 5 of the game piece 4.

Such game pieces 4 can for example be used for a 3D puzzle, whereby the aim is to fill a volume without gaps or overlaps.

Figure 43:
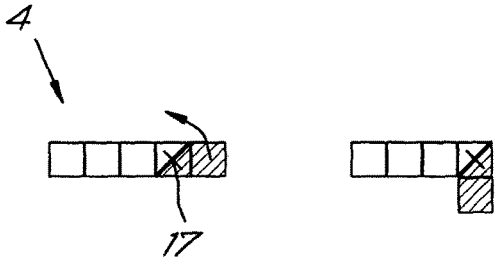

FIG. 43 shows a variant of a game piece 4 according to the invention in the form of a polycube whereby one cubic block is divided into two parts along a diagonal plane that can be turned with respect to one another around a hinge 17 perpendicular to this diagonal plane.

Figure 44:
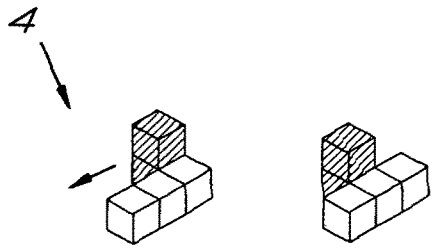

FIG. 44 shows a another variant of a polycube that is divided into two parts that can be slid with respect one another.

Figure 45:
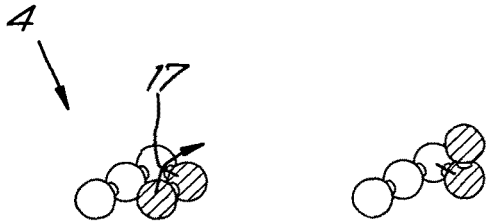

FIG. 45 shows another variant of a 3D game piece 4 according to the invention, whereby in this case the cubic blocks are replaced by balls, a number of which are connected together in a fixed way, and whereby in this case two balls are connected together by a hinge 17 so that they can be turned.

Figure 46:
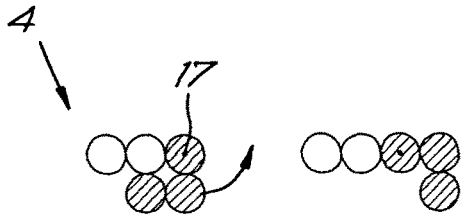

FIG. 46 shows an embodiment in which one of the balls consists of two half balls that can be turned with respect one another according to a hinge 17 perpendicular to the separating plane between the two other forms.

It is clear that the blocks can also take on other 2D and 3D forms that are connected together in an orthogonal pattern.

It is clear that the game pieces according to the invention can not only be used to replace the game pieces of existing games, but such game pieces can also give rise to new games.

The present invention is by no means limited to the embodiments described as an example and shown in the drawings, but a game piece according to the invention can be realised in all kinds of variants, without departing from the scope of the invention.

The invention claimed is:

1. A polyomino game piece comprising:

at least two slidable polyomino parts, at least one of said slidable parts is a polyomino comprising at least two blocks that are permanently attached together in an orthogonal pattern to form the slidable part, at least a second of said slidable parts is a polyomino comprising at least two blocks that are permanently attached together in an orthogonal pattern or is a single block;

wherein the at least two slidable parts are slidably coupled together to form a game piece in a configuration which may be altered by sliding one slidable part relative to the other to form a different polyomino configuration.

2. A game piece according to claim 1, wherein the coupled slidable parts slide along one side of the blocks with respect to one another in a direction parallel to one of the sides of a block, and wherein the coupled parts have a first sub-part and second sub-part that are connected together, and form a groove coinciding with the connection on the side along which the parts of the game piece can be slid with respect to one another, and said groove retains a sliding coupling part in a slidable way.

3. A game piece according to claim 2, wherein each of the slidable parts is hollow, the first sub-part is a base and the second sub-part is a cover, the base and the cover are connected together along their periphery by edges, and wherein the groove is in the edges.

4. A game piece according to claim 2, wherein the sliding part forms a link between the two slidable parts of the game piece that can slide with respect to one another, and wherein the sliding coupling part has an I-shaped profile with two parallel flanges that are connected together by a central rib, whereby the edges of the grooves of the two slidable parts of the game piece that are connected together in a slidable way, are held between the aforementioned parallel flanges of the sliding coupling part.

5. A game piece according to claim 2, wherein the game piece is provided with means which provide a sensible feedback when parts are in an intended position with respect to each other to form a new polyomino configuration, and wherein the means which provide a sensible feedback when slidable parts are in an intended position with respect to each other are formed by at least one projection on the sliding parts and recesses in the slidable parts.

6. A game piece according to claim 1, wherein the total number of blocks forming the game piece is five.

7. A game piece according to claim 1, wherein one of the slidable parts is a single slidable block.

8. A game piece according to claim 1, wherein a protruding part extends from one side that prevents the game piece from lying on this side.

9. A game piece according to claim 1, wherein the total number of blocks forming the game piece is six.

10. A game piece according to claim 1, wherein slidable parts can be moved with respect to one another in such a way that they enable different forms of polyominoes to be formed with a game piece.

11. A game piece according to claim 1, wherein the game piece only contains two such slidable parts that can be moved with respect to one another.

12. A game piece according to claim 1, wherein the total number of blocks forming the game piece is four.

13. A game kit comprising a set of game pieces according to claim 1, and a corresponding game board configured to receive said pieces.

14. A game piece according to claim 1, wherein the slidable polyomino parts are only slidable with respect to each other in a single plane.

15. A game piece according to claim 1, wherein the polyomino game piece only extends in one or two, not three orthogonal directions.

16. A game piece according to claim 1, wherein the slidable polyomino parts are inextricably but slidable connected.

* * * * *